US005437079A

United States Patent [19]

Park

[11] Patent Number: 5,437,079

[45] Date of Patent: Aug. 1, 1995

[54] DOOR HINGE

[76] Inventor: Kabil Park, 47-22, Ogin-Dong, Chongro-Gu, Seoul, Rep. of Korea, 110-035

[21] Appl. No.: 328,200

[22] Filed: Sep. 28, 1994

Related U.S. Application Data

[63] Continuation-in-part of Ser. No. 72,559, Jun. 7, 1993, abandoned.

[30] Foreign Application Priority Data

Jun. 10, 1992 [KR] Rep. of Korea ..... 92-10282 U

[51] Int. Cl.[6] ..... E05F 3/08; E05F 3/10

[52] U.S. Cl. ..... 16/54; 16/295

[58] Field of Search ..... 16/54, 50, 285, 295, 16/304, 308, 74, 75

[56] References Cited

U.S. PATENT DOCUMENTS

| | | | |
|---|---|---|---|
| 340,790 | 4/1886 | Kochsmeier et al. | 16/295 |
| 495,965 | 4/1893 | Ennis | 16/295 |
| 508,249 | 11/1893 | Shaw | 16/295 |
| 1,731,561 | 10/1929 | Campbell et al. | 16/50 |
| 2,235,984 | 3/1941 | Devereaux | 16/295 |
| 2,971,212 | 2/1961 | Voster et al. | 16/55 |

OTHER PUBLICATIONS

Abstract of the Japanese 64/309942, Jul. 31, 1991.

*Primary Examiner*—Mark Rosenbaum
*Assistant Examiner*—Chuck Y. Mah
*Attorney, Agent, or Firm*—Watson, Cole, Grindle & Watson

[57] ABSTRACT

A door hinge having the is capable of not only automatically closing the door but also controlling the closing speed. The hinge includes a first hinge part, a second hinge part, a hinge-shaft on which the two hinge parts are pivotably mounted, a spring for returning the second hinge part to a determind position in relation to the first hinge part, and a buffer assembly arranged between the two hinge parts.

6 Claims, 3 Drawing Sheets

DOOR HINGE

This is a Continuation-in-Part of application Ser. No. 08/072,559 filed Jun. 7, 1993, now abandoned.

BACKGROUND OF THE INVENTION

The present invention relates to a door hinge for use in installing, for example, a conventional building door or a fireproof-door or an emergency door in a fireproof-shutter, especially being capable of automatically closing the door and controlling the closing speed.

There are basically two types of known hinges. The first one, for-example such as the common door hinges, allows a door to swivel around a hinge-shaft without any auto-close function. The second one, for example such as the one discussed in Japanese Patent Appln. No, Sho 64-309942, has an auto-close function provided by a simple spring means. However, the former is disadvantageous in that in order to provide a door to be installed with an auto-close function an expensive and bulk door-closer should be additionally mounted door. The latter has the problem of impact noise whenever the door closes. Also the door may injure passers-by due to its uncontrolled closing speed.

SUMMARY OF THE INVENTION

The present invention is to provide a door hinge that will not only automatically close the door, but also control the speed of the door closing so that the opened door can always be automatically and smoothly closed without any noise.

According to the invention, this purpose can be accomplished by providing a buffer means as well as a coil-spring between a first hinge part and a second hinge part which are pivotably mounted on a hinge-shaft.

The hinge according to the present invention is characterized in that it comprises the first hinge part, the second hinge part, a hinge-shaft on which the two hinge parts are pivotably mounted, a spring means for returning the second hinge part to a predetermined position relative to the first hinge part, and a buffer means arranged between the first and the second hinge parts.

Further, the hinge is characterized in that one part of the buffer means is pivotably connected to the first hinge part and another part of the buffer means is pivotably connected to an extended part of the second hinge part.

Further, the hinge is characterized in that its buffer means comprises a cylinder and a piston, said cylinder having a by-pass that communicates with the main chamber of the cylinder through a plurality of fluid passages.

DETAILED DESCRIPTION OF THE INVENTION

Figure 1:
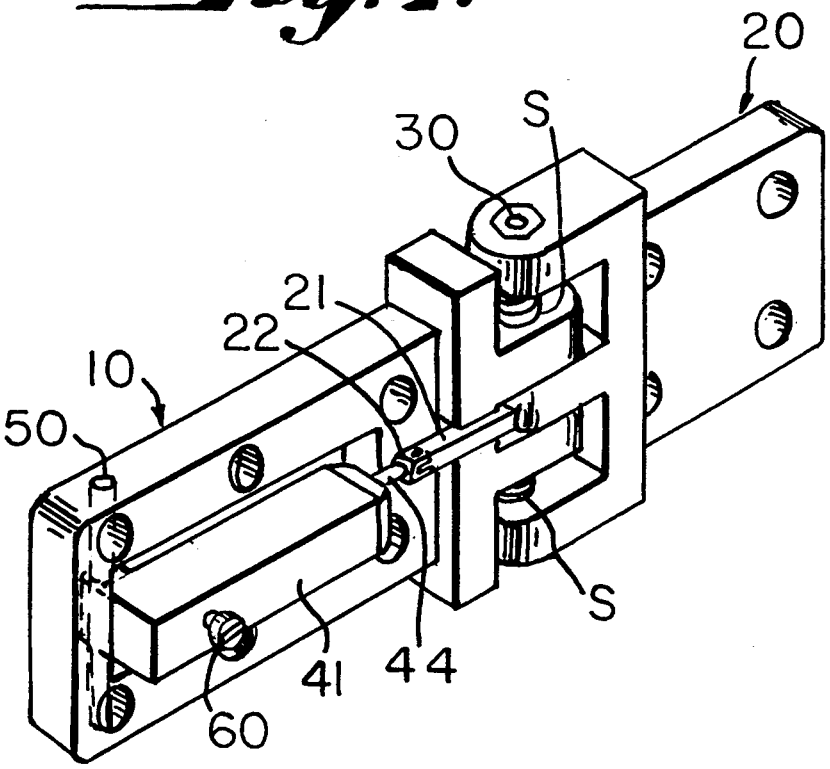
FIG. 1 is a perspective view of the door hinge according to the present invention.
Figure 2:
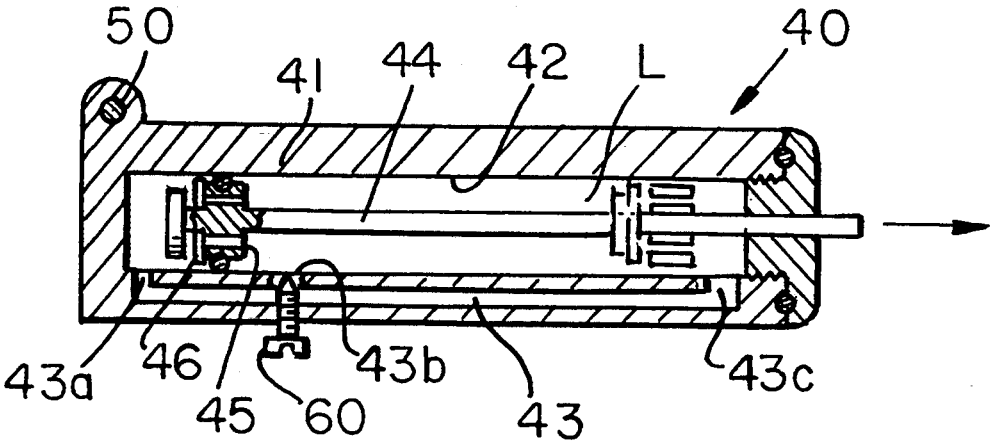
FIG. 2 is a cross-sectional view of the buffer assembly incorporated into the FIG. 1.

As shown in the drawings, the hinge according to the present invention comprises two hinge parts (10) and (20) and a hinge-shaft (30) on which the above two hinge parts are pivotably mounted.

In this hinge, a spring (S) is provided on the hinge-shaft (30) for returning the second hinge part (20) to which the door is to be fixed to a predetermined position in relation to the first hinge part which is to be fixed to the wall. A buffer assembly (40) is arranged between the two hinge parts (10) and (20) for controlling the returning speed of the second hinge part (20).

The buffer means (40) comprises a cylinder (41) and a piston (44). The rear end part of the cylinder (41) is pivotably connected to the first hinge part (10) through a pin (50), while the front end part of the piston (44) is pivotably connected to the extended part (21) of the second hinge part (20) through a pin (22).

The cylinder (41) is provided with a by-pass channel (43) on one side of its main chamber (42). The by-pass (43) communicates with the main chamber (42) through three fluid-passages **(43*a*), (43*b*), (43*c*), the first one (43*a*) of which is arranged near the bottom side (in the drawings, left end side) of the chamber (42), the third one (43*c*) near the toy side (in the drawings, right end side) of the chamber (43), and the second one (43*b*) near the first fluid-passage (43*a*). Further, the cylinder (41) is provided with an adjusting screw (60) for adjusting the opening of the second fluid-passage (43*b*)**.

On the head of the piston (44), a plurality of holes (45) and a valve member (46) are arranged. The valve member (46) is arranged on the head of the piston (44) in such a manner that it prevents the working fluid (L) filled in the cylinder (41) from passing through the holes (45) when the piston (44) is in a backward movement, and allows the working fluid (L) to freely pass through the holes (45) when the piston (44) is in a forward movement.

With the above arrangement, the hinge can not only pivotably support a door as a conventional one does but also automatically and smoothly close the opened door by the spring means (S) and the buffer means (40).

Figure 3:
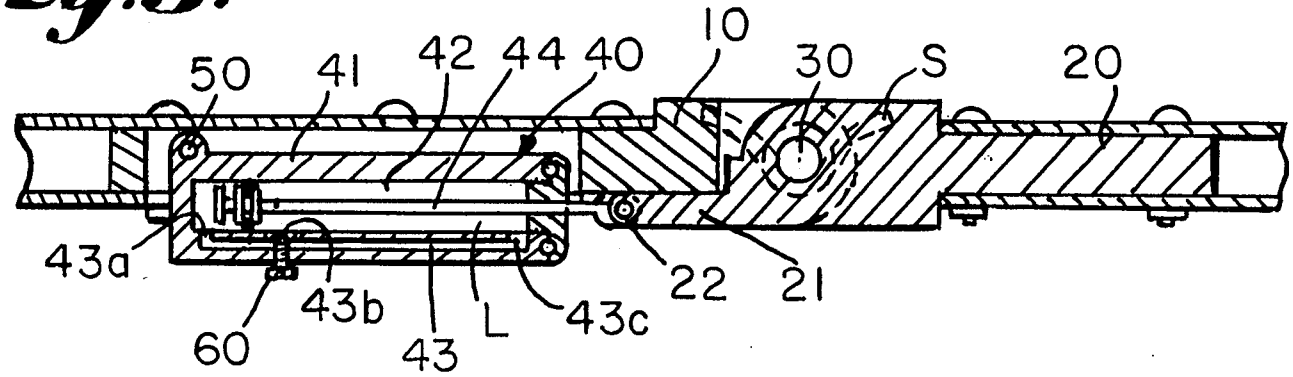
FIG. 3 is a cross-sectional view of the FIG. 1 when the door is closed.
Figure 4:
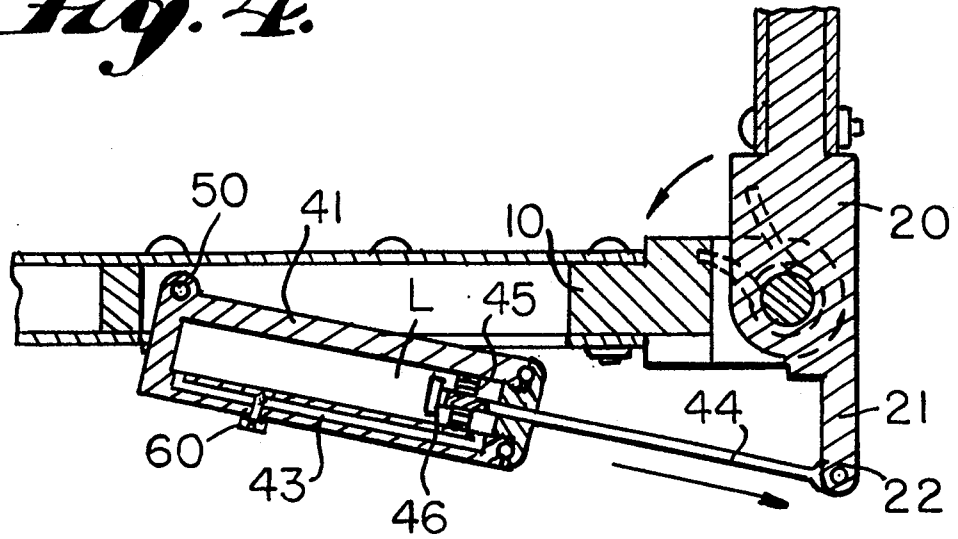
FIG. 4 is a cross-sectional view of the FIG. 1 when the door is opened.

In operation, FIG. 3 shows the closed condition of the door engaged and FIG. 4 shows the opened condition of the door engaged. When the door is being closed from the condition of FIG. 4 to that of FIG. 3 by the force of the spring means (S), the piston (44) has to move into the cylinder (41) pushing through the working fluid (L) in the cylinder. At this moment, the vane member (46) comes to close the holes (45) in the head of the piston (44) by the pressure of the working fluid (L), whereby the working fluid (L) in the main chamber (42) of the cylinder (41) flowing into the by-pass (43) through the first and second fluid-passages **(43*a*), (43*b*), and the working fluid (L) in the by-pass (43) flowing into the main chamber (42) of the cylinder (41) through the third fluid passage (43*c*). Under this condition, the moving speed of the piston (44) depends upon the flowing speed of the working fluid (L) in the cylinder (41). Consequently, the closing speed of the door engaged can be slowed down by the working fluid (L) and controlled to a suitable degree by adjusting the flowing mount of the fluid through the by-pass (43) by means of the screw (60)**.

In the above operation, some amount of the working fluid (L) in the main chamber (42) of the cylinder (41)

will flow into the by-pass (43) through the first and second fluid-passages (43*a*) (43*b*) until the piston head arrives at the position of the second fluid-passage (43*b*), whereby the door engaged will be relatively rapidly closed, while less amount of the fluid than the above will flow into the by-pass (43) only through the first fluid-passage (43*a*) after the piston has passed over the position of the second fluid passage (43*b*), whereby the door engaged being more slowly closed. Accordingly, with the above hinge, the door engaged can be closed as fast and smoothly as possible in the beginning of its closing movement, and can be more slowly closed in the end of its closing movement.

On the other hand, when the door is being opened as in FIG. 4, the valve member (46) on the piston head will open the holes (45) to allow the working fluid (L) in the chamber (42) to freely pass through the holes (45).

Consequently, the door can be easily opened regardless of the buffer assembly (40).

In the embodiment shown in FIGS. 1–5, the first hinge part defines a recess 52, which may be a hole as shown. The cylinder 41 is pivoted to swing into and out of the recess 52. The second hinge part has the extended part 21 pivotally connected to the outer end of said piston rod 44. The first hinge part has a slot 54 formed therein for receiving the extended part 21 when the hinge is in the closed position. Two torsion springs S are used in the embodiment shown, as particularly illustrated in FIG. 5.

Figure 5:
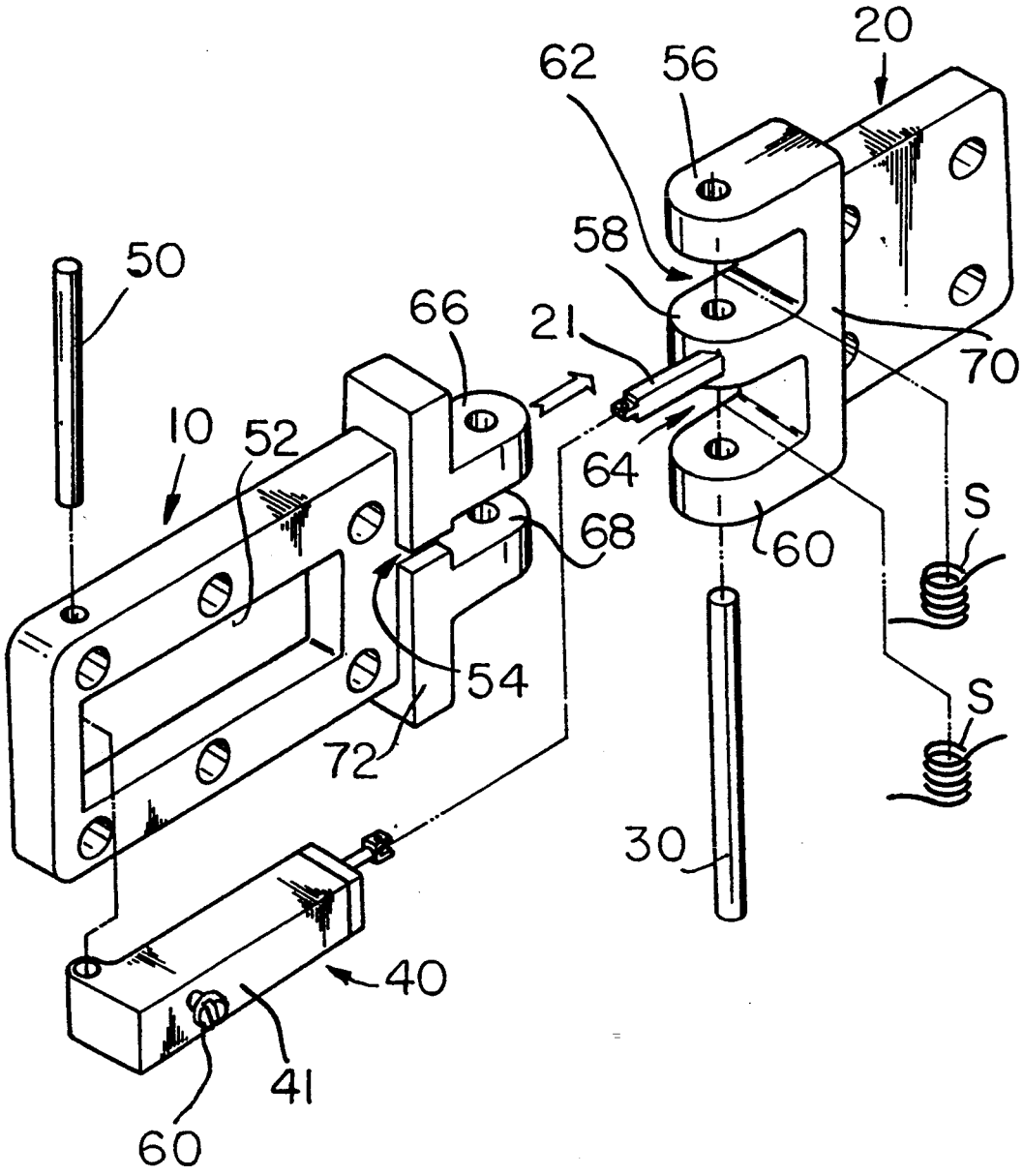
FIG. 5 shows an exploded view of the hinge shown in FIG. 1.

In the embodiment illustrated, the second hinge part 20 includes three parallel portions 56, 58, 60, which define two openings 62, 64. The first hinge part includes two parallel portions 66, 68 which nest within the two openings 62, 64. The second hinge part has opposite faces, only one of which, 70, is shown in FIG. 5. The extended part 21 extends laterally from the face 70. The first hinge part has opposite faces, only one of which, 72, is shown in FIG. 5. The slot 54 is formed within the face 72 of the first hinge part.

With the above ideal arrangements, the hinge according to the present invention further has the advantages of providing the required operations without fall at all times and of being as compact as possible.

The hinge according to the present invention described above can be advantageously employed in installing a building door, or a fireproof-door, or an emergency door in a fireproof-shutter.

What is claimed is:

1. A door hinge comprising, a first hinge part, a second hinge part, a hinge shaft, said first and second parts being pivotally mounted on said hinge shaft, a torsion spring disposed in surrounding relationship to said shaft and having two ends, one of said ends engaging said first hinge part, the other of said ends engaging said second hinge part, buffer means including a cylinder filled with working fluid and a piston movably mounted in said cylinder, a piston rod connected to said piston and having an outer end extending outwardly of one end of said cylinder, said first hinge part defining a recess, said cylinder having an opposite end pivotally mounted on said first hinge part so that the cylinder can swing into and out of said recess, said second hinge part having an extended part pivotally connected to the outer end of said piston rod, said first hinge part having a slot formed therein for receiving said extended part when the hinge is in closed position.

2. A door hinge as defined in claim 1, further including a second torsion spring in surrounding relationship to said hinge shaft and having two ends, one end of said second torsion spring being in contact with said first hinge part and the other end of said second torsion spring being in contact with said second hinge part.

3. A door hinge as defined in claim 1, wherein said recess is a hole.

4. A door hinge as defined in claim 1, wherein said second hinge part includes three parallel portions which define two openings, and said first hinge part includes two parallel portions nested within said two openings.

5. A door hinge as defined in claim 1, wherein said second hinge part has opposite faces and said extended part extends laterally from one of the faces.

6. A door hinge as defined in claim 5, wherein said first hinge part has opposite faces and said slot is formed within one face of the first hinge part.

* * * * *